US005548857A

United States Patent [19]

Richmond

[11] Patent Number: 5,548,857

[45] Date of Patent: Aug. 27, 1996

[54] BOX SPRING HAVING SNAP-ON CLIP FOR SPRING SECUREMENT

[75] Inventor: Darrell A. Richmond, Carthage, Mo.

[73] Assignee: L & P Property Management Company, Chicago, Ill.

[21] Appl. No.: 320,138

[22] Filed: Oct. 11, 1994

[51] Int. Cl.[6] ..... A47C 23/057

[52] U.S. Cl. ..... 5/263; 5/259.1; 267/100; 267/103; 403/397

[58] Field of Search ..... 5/259.1, 263, 264.1; 267/100, 103; 403/389, 391, 397; 24/336

[56] References Cited

U.S. PATENT DOCUMENTS

| | | | |
|---|---|---|---|
| 3,288,503 | 5/1964 | Slominski . | |
| 3,628,780 | 12/1971 | Saito . | |
| 3,681,794 | 8/1972 | Ciampa et al. | 5/263 X |
| 3,773,310 | 11/1973 | Crosby . | |
| 3,783,459 | 1/1974 | Piliero | 5/259.1 |
| 3,888,474 | 6/1975 | Madusky et al. . | |
| 4,029,303 | 6/1977 | Quakenbush . | |
| 4,038,711 | 8/1977 | Golembeck et al. | 5/263 |
| 4,095,298 | 6/1978 | Pringle | 5/263 |
| 4,592,103 | 6/1986 | Hagemeister | 5/263 |
| 4,709,906 | 12/1987 | Mizelle . | |
| 5,369,822 | 12/1994 | Dennison | 267/103 X |

*Primary Examiner*—Michael F. Trettel
*Attorney, Agent, or Firm*—Wood, Herron & Evans

[57] ABSTRACT

A box spring includes a border frame with an opening therethrough and spaced and parallel slats extending thereacross, a wire grid spaced from and parallel with the border frame and slats, and a plurality of springs extending between the wire grid and the border frame/slats, wherein the internally located springs have ends which are secured to plastic clips, and each of these clips is removably secured to one of the slats via a snap-on connection. Each of the clips also has a hook for removably retaining a spring portion. The snap-on connections of these spring holding clips, and additionally, the hooks for removable spring retention, facilitate interconnection of the wire grid to the border frame/slats. The snap-on clips of this invention reduce the costs associated with construction and assembly of a box spring, while providing secure interconnection of the internal springs.

22 Claims, 2 Drawing Sheets

BOX SPRING HAVING SNAP-ON CLIP FOR SPRING SECUREMENT

FIELD OF THE INVENTION

This invention relates to a box spring for supporting a bedding mattress, and more particularly, to a box spring having plastic clips for securing the springs of a box spring to the internal frame components of the box spring.

BACKGROUND OF THE INVENTION

A typical bedding mattress foundation or so called "box spring", or box spring assembly, comprises a rectangularly-shaped structure of substantially uniform thickness having an outer, upholstered cloth cover. The structure has sufficient resiliency to compress upon application of a force, such as the weight of a person sitting or reclining, yet it also has sufficient rigidity to return to an uncompressed state when the force is removed.

Within the cloth cover, a box spring usually has a rigid peripheral frame which is connected to a plurality of internal springs, which are typically made of wire. Together, the springs and the frame form an internal lattice for the box spring. This lattice provides sufficient rigidity and structural integrity for maintaining the rectangular shape, with the springs providing the necessary resiliency. Within this lattice, the springs must be connected to the members which comprise the peripheral frame, and the springs must be connected such that they remain connected over a long period of use.

Because of the need to connect the springs to these other members of the lattice, the construction of a box spring, and particularly the internal lattice of the box spring, is relatively time consuming and labor-intensive. This is particularly true if stapled connections must be made or if mechanical fasteners are necessary to connect the springs to the frame.

In some box spring structures, intermediary pieces are used to interconnect the springs to the lattice members at one or both ends of the springs. For instance, Mandusky et al. U.S. Pat. No. 3,888,474 discloses a retention clip for interconnecting one end of an internal spring to a metal frame rail of a box spring, wherein one side of the retention clip is readily mountable to and slidable along the frame rail, and the other side of the clip is adapted to hold one end of a wire spring. This slidable retention clip enables the use of any desired number of springs and eliminates the need to staple the clip and/or the spring to the frame rail, or the need to use additional fasteners to secure the retention clips and/or the springs to the frame rails.

The clip disclosed in this patent appears to solve some of the construction problems associated with forming a lattice for a box spring. However, the retention clip shown in FIG. 3 of this patent is secured to a rail edge at only one end of the retention clip. The other end of the clip simply rests on the opposite side of the rail. This free end of the clip appears susceptible to vertical movement as the spring attached thereto is vertically compressed and extended, as is common over a period of use. This could eventually lead to disconnection of the clip and/or the spring from the rail.

FIG. 4 of this Mandusky et al. patent shows a symmetric rail with opposing upper side edges, but the retention clip again only has one end secured to one upper side edge of the rail. The other side edge of the rail includes indentations for receiving projections formed on the other end of the retention clip. This construction of the rail appears more secure because both ends of the clip are held. However, the formation of these indentations in the rails requires an extra manufacturing step, as does the formation of the projections in the retention clips. These additional manufacturing steps add additional costs to the box spring.

Also, forming the indentations along the entire length of the rail is relatively costly when considering that only a small number of the indentations are actually used to hold retention clips.

Finally, with the projections fit into the indentations, the clips are no longer slidable along the frame rail after final connection.

SUMMARY OF THE INVENTION

It is an object of this invention to reduce the time and labor costs associated with constructing a box spring.

It is another object of this invention to facilitate and simplify the making of interconnections between the springs of a box spring and the rigid members of a lattice of a box spring.

It is still another objective of the invention to improve the durability and the wear of the interconnections between springs and the lattice member of a box spring, without increasing the complexity or cost of the box spring.

The above-stated objects are achieved by a box spring which employs one or more snap-on clips to interconnect internal spring ends to slat members which form part of the lattice of the box spring structure. Each snap-on clip includes a pair of opposing catches which easily snap around the side edges of a slat, so that securement thereto is relatively easy and the clip is slidable along the slat. Yet, this connection is sufficiently secure to withstand the vertical forces typically placed upon the springs and in turn the clips over a period of use. Each of the clips also includes a hook for quick and easy securement thereto of a wire spring.

In short, the snap-on clips of this invention provide quick and easy interconnection between the internal slats and the internal springs of a box spring. This simplicity in interconnection reduces the time and labor necessary for manufacturing a box spring. Moreover, because of the structure of the snap-on clips, the interconnections between the slats and the springs are sufficiently secure to withstand the typical forces applied to a box spring, yet no additional manufacturing steps are required with respect to the slats or the springs, or any other box spring components.

According to a preferred embodiment of the invention, a box spring includes a rectangularly shaped rigid/resilient lattice of substantially uniform thickness, which is enclosed within an upholstered cover. Preferably, a pad is placed atop the lattice within the cover. The lattice includes a wire grid spaced from and parallel to a frame grid. The frame grid includes a rectangular border, preferably of wood, having an opening therethrough. A plurality of spaced and parallel metal slats extend across the opening, and the ends of the slats are secured to two opposite sides of the border by mechanical fasteners, such as nails. The slats are uniform in cross section, and each is symmetric with respect to its longitudinal axis. A supporting brace may be connected perpendicular to the slats, and arranged so as to also span the opening.

A plurality of springs have first ends thereof secured to the wire grid, preferably in a snap-fit manner which allows easy assembly without the use of tools. The springs located adjacent the perimeter of the box spring, or aligned with the border defined by the frame grid, are secured to the border with mechanical fasteners, such as nails or staples. The other springs, i.e. the internal springs, form a significant portion of the entire number and are aligned with the opening. The second ends of these internal springs reside adjacent a slat. For these springs, the snap-on plastic clips provide interconnection of the second ends with the slats in a quick and easy, yet secure and quiet manner.

Depending upon the shape and configuration of the springs, each spring may have more than one connection point, at either its first or second end. The preferred embodiment of this invention relates to springs with two connection points at the second end.

The snap-on clips of this invention are preferably molded out of plastic, and the size of the clips is determined by the width of the slats. The slats may be formed from sheet metal via a few relatively simple cutting and bending steps. This construction allows some slidable movement of the clips with respect to the slats, an advantageous feature during manufacture and an advantageous feature thereafter, due to the increased ability to withstand laterally-directed forces on the box spring, and other similar types of wear.

Thus, in addition to a cost savings attributable to the ease in interconnection of the springs to the opposing parallel grids of a box spring, this invention also minimizes the costs associated with manufacture the interconnecting components of a box spring, and improves the overall durability of the box spring.

These and other features of the invention will be more readily understood in view of the drawings and the detailed description.

DETAILED DESCRIPTION OF THE INVENTION

Figure 1:
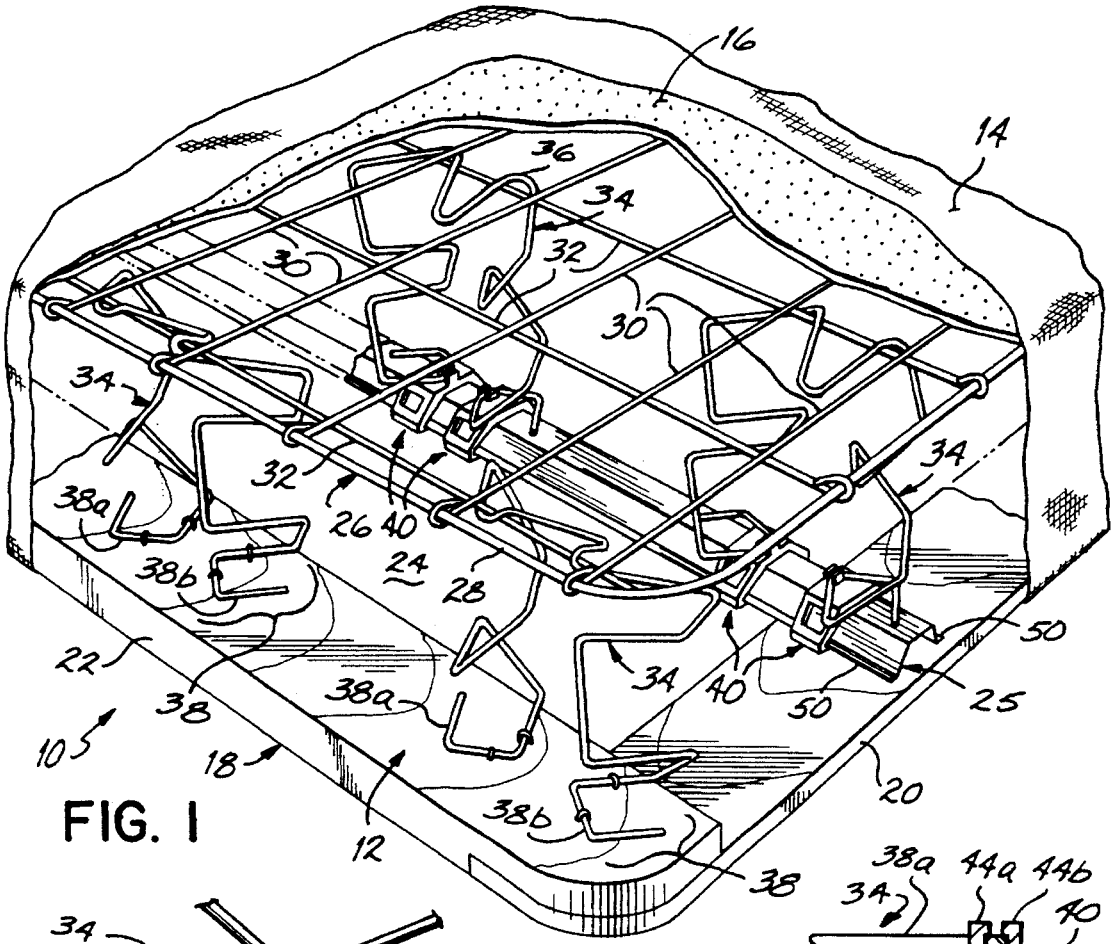
FIG. 1 is a perspective, in broken-away view, of a corner of a box spring constructed in accordance with a preferred embodiment of the invention.

FIG. 1 shows a perspective view, partially broken away, of a box spring 10, or box spring assembly, constructed in accordance with a preferred embodiment of the invention. The box spring 10 includes an internal support structure 12, or lattice, which is enclosed within an upholstered cloth cover 14. On one side of the lattice 12, a pad 16 resides within the cover 14. Typically, the box spring 10 is rectangular in shape and forms a resilient support for a bedding mattress. The cover 14 presents an aesthetically appealing external appearance, while also protecting the internal lattice 12. The pad 16 prevent outward protrusion of the components of the lattice 12.

Figure 1A:
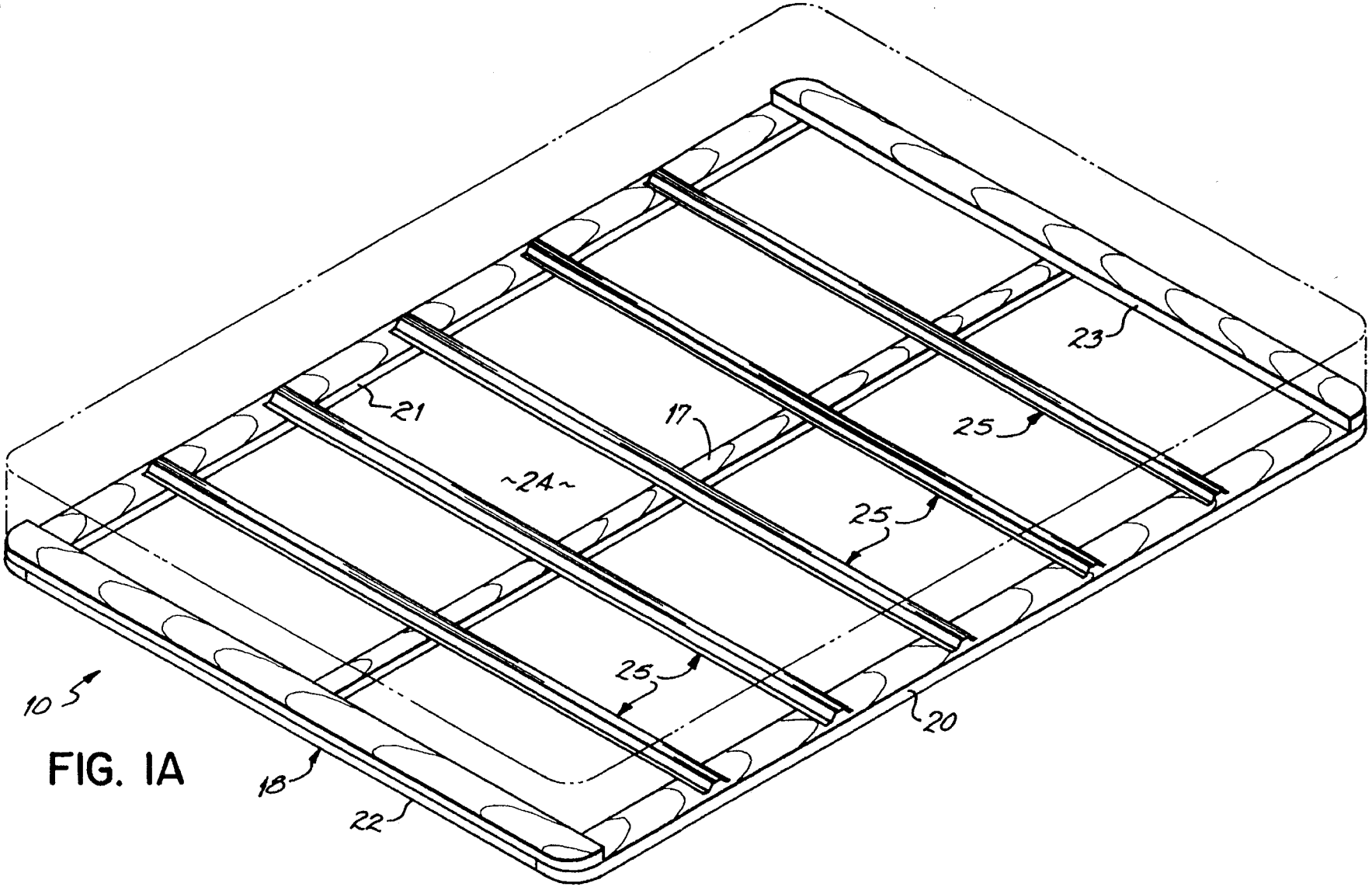
FIG. 1A is a perspective view of a box spring border frame constructed in accordance with a preferred embodiment of the invention.

The lattice 12 itself provides structural integrity for the box spring 10, by providing a degree of resiliency or "give" to achieve a desired degree of comfort when a force is applied, while also maintaining sufficient structural integrity to return to the original rectangular shape after the force is removed. The lattice 12 further includes a border frame 18, or first grid member. This border frame 18 includes a pair of spaced and parallel side border members 20 and 21 oriented in a first direction, and a second pair of spaced and parallel end border members 22 and 23 arranged in a second orientation, preferably perpendicular to the first direction. The spaced side border members 20 and 21 and spaced end border members 22 and 23 have their ends interconnected via fasteners (not shown) to form a rectangular shape, with an opening 24 located therein. One or more spaced and parallel metal slats 25 span across the opening 24, with the total number of slats 25 depending on the size and configuration of the border frame 18. Also, a wooden supporting brace 17 may also span the opening 24 and intersect with the slats 25 (FIG. 1A).

While FIG. 1 of this application refers to a first frame member 18 which is rectangular in shape and defining a rectangular opening 24, it is to be understood that the principles of this invention may be applied to box springs 10 having a variety of different shapes and/or configurations.

Spaced from and oriented parallel with the first bottom grid 18 is a second top wire grid 26. This second grid 26 preferably comprises multiple interconnected wires. More specifically, the second or top wire grid 26 includes a perimeter or border wire 28, a first set of parallel wires 30 arranged and spaced in parallel orientation along a first direction, and a second set 32 of spaced and parallel wires arranged in a second direction, which is preferably perpendicular to the first. Again, while the second grid 26 is described with respect to the first set 30 and the second set 32 of wires arranged in perpendicular orientation, any planar grid-like structure 26 would be suitable for use with this invention, provided the grid 26 has sufficient rigidity to maintain a generally planar shape, and further provided it is adapted for spaced securement with the first grid 18.

This spaced securement is provided by a plurality of springs 34 which span and interconnect the first grid 18 with the second grid 26. These springs 34 are preferably made of wire. FIG. 1 shows springs 34 having an inverted U-shape which applicant has found advantageous, though it is to be understood that various spring shapes may be used to achieve the advantages of this invention. Each of the springs 34 has a top or first end 36 secured to the top wire grid 26 and a second or bottom end 38 secured to the base or bottom border frame 18. With the springs 34 shown in the Figures, the bottom ends 38 actually comprise two end pieces or bottom feet 38*a* and 38*b*, for two connections. At the outer perimeter of the lattice 12 and in alignment with the border frame 18, the springs 34 are secured to an opposing pair of the border members 22 and 23 via mechanical fasteners, such as nails or staples.

The other springs 34, those located above or in alignment with the opening 24, are not secured to any of the spaced border members 20, 21, 22 or 23. Rather, these other springs 34 are aligned with the supporting slats 25 for removable connection thereto via snap-on clips or connectors 40. The snap-on clips 40 provide interconnection between the first grid 18 and the second grid 26, via removable securement of the snap-on clips 40 to the slats 25 and to securement of the bottom ends 38 of the internal springs 34.

Figure 2:
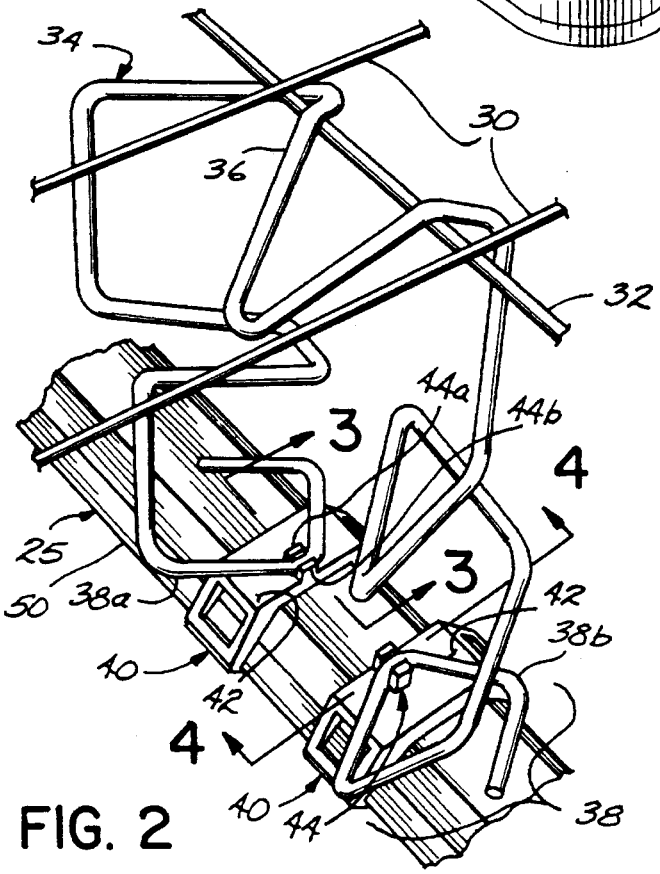
FIG. 2 is a perspective view of snap-on clip interconnecting a slat and a spring of a box spring constructed in accordance with a preferred embodiment of the invention.

FIG. 2 is illustrative of the structural relationship among the slats 25, the clips 40, the springs 34, and the wire grid 26. Due to the inverted U-shape of the springs 34, i.e. enclosed at the top with two open ends at the bottom, for each spring 34 a pair of clips 40 are needed to connect the two bottom end pieces 38*a* and 38*b* to a slat 25. Collectively, these two end pieces 38*a* and 38*b* are referred to as the second ends 38 of the springs 34.

Figure 3:
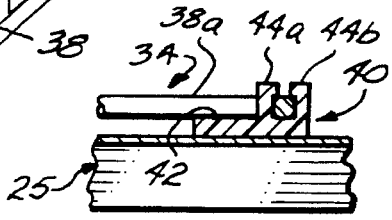
FIG. 3 is a transverse cross sectional view taken along lines 3—3 of FIG. 2.

To removably retain a spring 34, an upper side 42 of each clip 40 includes a hook 44 adapted to removably retain a bottom end piece 38*a* or 38*b* of a spring 34. FIG. 3 shows a two-portion hook 44, with opposing portions 44*a* and 44*b* for engaging a bottom end piece 38*a* of the spring 34 on opposite sides thereof.

Figure 5:
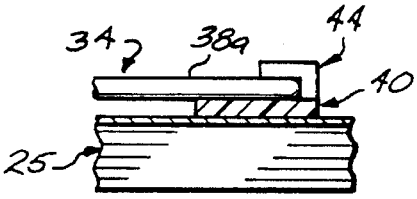
FIG. 5 is a transverse cross sectional view, similar to FIG. 3, which shows a clip with an alternative hook construction for securing a spring thereto.

FIG. 5 shows an alternative construction for the hook 44, wherein the bottom end piece 38*a* of the spring 34 is simply moved horizontally thereunder for securement thereto.

With the construction shown in FIG. 3, the spring 34 is retained to the clip 40 simply by vertically pressing the bottom end 38 thereof downward between the hook portions 44*a* and 44*b*. This is done for both end pieces 38*a* and 38*b* of each spring 34 having the inverted U-configuration.

The first or upper end 36 of each spring 34 has a downwardly bent midsection which wraps around one of the wires of the second grid 26. This wraparound connection facilitates manufacture and assembly of the lattice 12 because no welding step nor mechanical fasteners are required for interconnecting the springs 34 to the second grid 26.

In addition to simplified interconnection of the springs 34 to the snap-on clips 40, each of the snap-on clips 40 is easily connectable to the metal slats 25 via a direct snap-on connection. More specifically, each clip 40 has a pair of opposing catches 48 which engage opposing outer edges 50 of the slats 25. The sizing of the clip 40, and particularly the catches 48, is such that the clip 40 may be easily snapped to a slat 25 to provide secure engagement thereto, but readily removed therefrom. Also, the clips 40 are somewhat slidable along the slats 25. This reduces wear on the interconnected clips 40 and springs 34, which is typically caused by transversely-directed forces.

Figure 4:
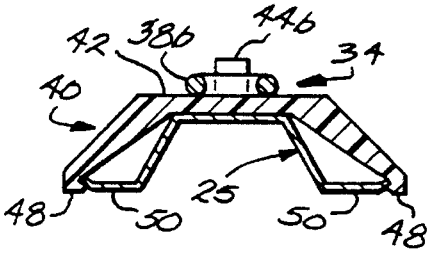
FIG. 4 is a longitudinal cross sectional view taken along lines 4—4 of FIG. 2.

The clips 40 are preferably molded from plastic, as by injection molding or compression molding, while the slats 25 are preferably formed via cutting of sheet metal into the desired width, and then bending the strips of sheet metal to achieve the cross-sectional configuration shown in FIG. 4. Because the slats 25 are formed from single sheets of sheet metal, the slats 25 have substantially uniform thickness, and manufacture is relatively inexpensive.

With this invention, the internally located springs 34 of a lattice 12 of a box spring 10 may be readily connected to spaced and parallel metal slats 25. More particularly, the invention facilitates quick, easy interconnection of spring ends 38 to supporting slats 25 without the use of any tools, and the resulting box spring is very quiet because of this steel spring to steel or metal slat connection via a plastic connector.

While the specific springs disclosed in this application as interconnecting the bottom or base grid 18 to the top or second grid 26 are modular springs specifically disclosed and described in the assignee's own U.S. Ser. No. 08/004, 534 other springs could as well be utilized in the practice of this invention. Such other springs could be modular, non-circular springs or conventional knotted or unknotted circular springs.

In constructing a box spring 10 which utilizes the snap-on clip 40 of this invention, the first grid 18 and the second grid 26 are arranged in spaced and parallel orientation, as known in the industry. The first grid 18 includes at least one supporting slat 25 having opposing side edges 50. Springs 34 are located and then interconnected between the two grids 26 and 18, first by connecting the first ends 36 to the wire grid 26. Along the outer perimeter of the border frame 18, the seconds ends 38 of the springs 34 are mechanically fastened thereto. However, the internal springs 34 have second ends 38 thereof, and specifically second end pieces 38*a* and 38*b*, removably secured to the hooks 44 of clips 40, which have been snap connected to the slats 25.

Due to the construction of the slats 25 and the clips 40, the clips 40 are also slidable with respect to the slats 25. In addition to providing better wear, as described above, this facilitates final connection of the second ends 38 of the springs 34, because the clips 40 do not have to initially be snap connected to the slats 25 in the exact final positions of use. Rather, the spring 34 may be connected to the slat 25, and then the spring 34 and clips 40 slid to their final position. Alternatively, if desired, the second ends 38 may be first secured to the clips 40, and then the clips 40 secured to the slats 25.

After the first end 36 and second end 38 of the springs 34 have been secured to the border frame 18 and the wire grid 26, respectively, the lattice 12 is complete and a pair of pads 16 may be placed on opposite sides of the lattice 12. Thereafter, the upholstered cover 14 is placed around the pad 16 and the lattice 12 to enclose and surround these internal structures to protect and provide an aesthetically pleasing outer surface for the box spring 10.

While the preferred embodiment of the invention has been described, it is not the intention of applicant to restrict or in any way limit the scope of the appended claims to such detail. Additional advantages and modifications will be readily apparent to those skilled in the art. The invention in its broader aspects is therefore not limited to the specific details, representative apparatus and method shown and described. Accordingly, departures may be made from such details without departing from the spirit or scope of applicant's general inventive concept.

I claim:

1. A box spring for supporting a bedding mattress, comprising:

a border frame having an opening therethrough;

at least one slat spanning the opening, the frame and the at least one slat residing substantially in a first plane;

a grid disposed in a second plane substantially parallel to the first plane;

a plurality of springs extending between the first and second planes, the springs having first and second ends, the first ends secured to the grid, some of the second ends secured to the frame and the others of the second ends aligned with the opening;

a plurality of clips, each of the clips having a first side with a snap-on connection for detachable connection to a slat and a second side with a two-portion hook sized to snap-fit a spring thereto, the others of the second ends of the springs removably secured to the two-portion hooks of the clips; and an upholstered cloth enclosing and covering the frame, the at least one slat, the grid, the springs and the clips.

2. The box spring of claim 1 wherein the border frame includes two pairs of spaced and parallel members which define a rectangular opening and a plurality of slats span the opening, the slats oriented parallel with one of the pairs of members which define the frame.

3. The box spring of claim 1 wherein each of the slats further comprises:

a sheet of material of substantially uniform thickness.

4. The box spring of claim 1 wherein the slats are metal.

5. The box spring of claim 1 wherein the clips are plastic.

6. The box spring of claim 1 wherein each of the slats has a pair of opposing edges located along the sides thereof and the snap-on connection of each clip includes a pair of inwardly directed catches sized and adapted to engage the opposing edges of a slat for removable securement thereto.

7. The box spring of claim 1 wherein the hook of each clip is oriented perpendicular to the respective slat.

8. The box spring of claim 7 wherein the two-portion hook of each clip comprises a pair of opposing members for removable engagement of a portion of the spring therebetween, said portion being sized to snap fit between the members via movement in a direction perpendicular to the second side of the clip.

9. The box spring of claim 1 wherein the two-portion hook of each clip comprises an L-shaped member attached to the second side of the clip with one leg thereof extending parallel to the second side, the spring sized to snap-fit between said parallel leg of the L-shaped member and the second side of the clip via movement in a direction parallel to the second side of the clip.

10. A box spring assembly for an article of furniture comprising:

a first grid member residing in a first plane, the first grid member including a plurality of spaced and parallel slats;

a second grid member residing in a second plane parallel to the first plane;

a plurality of clips, each of the clips having a first side and a second side, with a snap-on connection at the first side and a two-portion hook at the second side, the two-portion hook sized for snap-fit receipt of a spring and each of the clips removably connected to a slat via the respective snap-on connection; and a plurality of springs, each spring having a first end operatively connected to the first grid and a second end connected to the second grid, each of a portion of the springs having the respective first end thereof snap-fitted to one of the clips via the respective two-portion hook.

11. The box spring assembly of claim 10 wherein the second ends of said portion of the springs are removably secured to the second grid.

12. The box spring assembly of claim 10 wherein the first grid comprises a peripheral frame having an opening therethough and the plurality of parallel and spaced slats extend across the opening.

13. The box spring assembly of claim 12 wherein the frame is rectangular in shape and the opening is also rectangular in shape.

14. The box spring assembly of claim 10 wherein the second grid comprises a wire lattice.

15. The box spring assembly of claim 10 wherein each of the slats has opposing side edges and each snap-on connection comprises a pair of opposing catches which engage the opposing side edges of a respective slat.

16. The box spring assembly of claim 10 wherein each of the clips includes a two-portion hook for removable snap-fit securement thereto of one of the springs of said portion of springs via movement in a direction perpendicular to the second side of the clip.

17. The box spring assembly of claim 10 where each of the clips includes an L-shaped member attached to the second side of the clip with one leg thereof extending parallel to the second side, the spring sized to snap-fit between said parallel leg of the L-shaped member and the second side of the clip via movement in a direction parallel to the second side of the clip.

18. A method for interconnecting a wire grid to a frame grid via a plurality of springs, thereby to form an internal lattice for a box spring, the frame grid having an opening therethrough and including at least one slat extending thereacross, each of the springs having first and second ends, comprising the steps of:

a) securing the second ends of the springs to the wire grid; and b) securing the first ends of the springs to the frame grid, wherein a portion of the springs are aligned with the opening and first ends thereof are removably secured to said at least one slat via a plurality of clips equal in number to said portions of springs, wherein each of the clips is removably snap-connected to a slat and each clip has a two-portion hook sized to removably snap-fit a spring therein to interconnect the first and second grids.

19. The method of claim 18 wherein, for each of the springs in said portion of springs, step b) further comprises:

snap connecting a pair of opposing clip catches over opposite side edges of the respective slat, thereby to removably secure the clip to the at least one slat.

20. The method of claim 18 wherein the second ends of the springs are removably secured to the wire grid.

21. In a box spring having a frame grid and a wire grid interconnected to the frame grid in parallel relationship therewith via springs, the frame grid having an opening therethrough and at least one slat spanning the opening, the improvement comprising:

at least one clip, each said clip having a first side snap-connected to a slat for removable securement thereto and a second side with a two-portion hook sized to snap-fit a spring therein for removable securement of the spring between the wire grid and the frame grid, thereby to facilitate securement of the wire grid to the frame grid.

22. A box spring comprising:

a wire grid;

a plurality of springs having first and second ends, the second ends removably secured to the wire grid;

a frame grid oriented substantially parallel to the wire grid and interconnected thereto via securement to the first ends of the springs, the frame grid including a rectangular border defining an opening therethrough and a plurality of spaced and parallel slats extending thereacross; and a plurality of clips, each of the clips removably secured to one of the slats via a snap-on connection, and each of the clips further including a two-portion hook sized to snap-fit a spring for removably retaining the first end of the spring.

* * * * *